US006308447B1

(12) United States Patent
Tress

(10) Patent No.: US 6,308,447 B1
(45) Date of Patent: Oct. 30, 2001

(54) SITE MARKER

(76) Inventor: Delores Dee Tress, 6092 S. Bedford Pl., Chandler, AZ (US) 85249

( * ) Notice: Subject to any disclaimer, the term of this patent is extended or adjusted under 35 U.S.C. 154(b) by 0 days.

(21) Appl. No.: 09/523,160

(22) Filed: Mar. 10, 2000

Related U.S. Application Data

(63) Continuation-in-part of application No. 09/247,339, filed on Feb. 8, 1999, now abandoned.

(51) Int. Cl.[7] ..... G09F 15/00
(52) U.S. Cl. ..... 40/607; 40/660; 150/154
(58) Field of Search ..... 40/299.01, 320, 40/333, 607, 612, 645, 660, 665; D20/41; 150/159, 160, 163, 154

(56) References Cited

U.S. PATENT DOCUMENTS 2,904,128 * 9/1959 Boham et al. ..... 150/154 X
3,913,648 * 10/1975 Sessler ..... 150/159 X
4,660,310 * 4/1987 Farmer ..... 40/607
4,765,381 * 8/1988 Castle ..... 383/20
4,771,560 * 9/1988 Richards ..... 40/607
5,024,259 * 6/1991 Treadway ..... 150/159
5,351,733 * 10/1994 Ullman ..... 150/154
6,148,555 * 11/2000 Beauchamp et al. ..... 40/612

* cited by examiner

*Primary Examiner*—Brian K. Green

(57) ABSTRACT

A camping site marker fabricated from synthetic durable weather-resistant materials, light in weight and conveniently used in camping applications. The device is dimensioned to fit over a utility site hook-up post structure indicating the site is taken when the camper is departed from the site for the day. Additionally utilized by placing the device over the outside mirror structure of the recreational vehicle while parked at the site. The main embodiment is highly visible, fabricated with one or more brightly colored synthetic materials personalized with imprinted indicia. i.e. family names, camping clubs and logos.

8 Claims, 4 Drawing Sheets

SITE MARKER

CROSS-REFERENCE TO RELATED APPLICATIONS

This is a continuation in part of Ser. No. 09/247,339 filed on Feb. 8, 1999, now abandoned.

BACKGROUND OF THE INVENTION

1. Field of the Invention

The invention relates to outdoor camping site markers. Particularly the void of camping site markers.

2. State of the Art

It has been known for many years past and present, by those engaged in the recreation of camping may have marked their camping site with a piece of paper or paper plate bearing the word occupied or the family name and the like, maybe leaving articles of camping furniture to indicate their site is taken during their absence. These efforts, and others, of marking the site have sometimes failed as the weather or other forces may have removed or destroyed the articles left behind leaving no indicator at all the site is taken. Rendering the camping site unmarked and unattended thereby seemingly available. It is known that campers leaving markers of various descriptions or none at all have returned to their camp site only to find their camp site taken by another camper. It may be understood that no satisfactory device currently exists for marking a camping site occupied or in use. Particularly one that exists for mounting on a utility hook-up post structure and the like, that is highly visible, weather-resistant that remains intact.

SUMMARY OF THE INVENTION

It is therefore an object of the invention to provide a site marker for use in camping.

It is also an object of the invention to have relatively few and simple parts which can be inexpensively manufactured and utilized to a high degree of efficiency designed to be light in weight and easily compacted when not in use.

Another object of the invention is to provide a weather-resistant camping site marker for use on a utility hook-up post structure and the like, to display during the absence of the camper.

It is a further object of the invention to provide the camper the option of displaying the site marker over the outside mirror structure of the recreation vehicle while parked at the camping site.

It is also an object of the invention that indicia be imprinted on the main embodiment of the site marker personalizing the marker with a family name, hobby, state, picture, camping club name, logo and the like.

A preferred aspect of the invention includes providing multiple bright indicia on the main portion of the embodiment intended to be conspicuous, with multiple colors of synthetic weather-resistant material used in manufacturing the device.

Further additional objects of my invention will become apparent to those skilled in the art upon reference to the detailed description following taken in conjunction with the accompanying drawings.

DESCRIPTION OF THE PREFERRED EMBODIMENT

Figure 1:
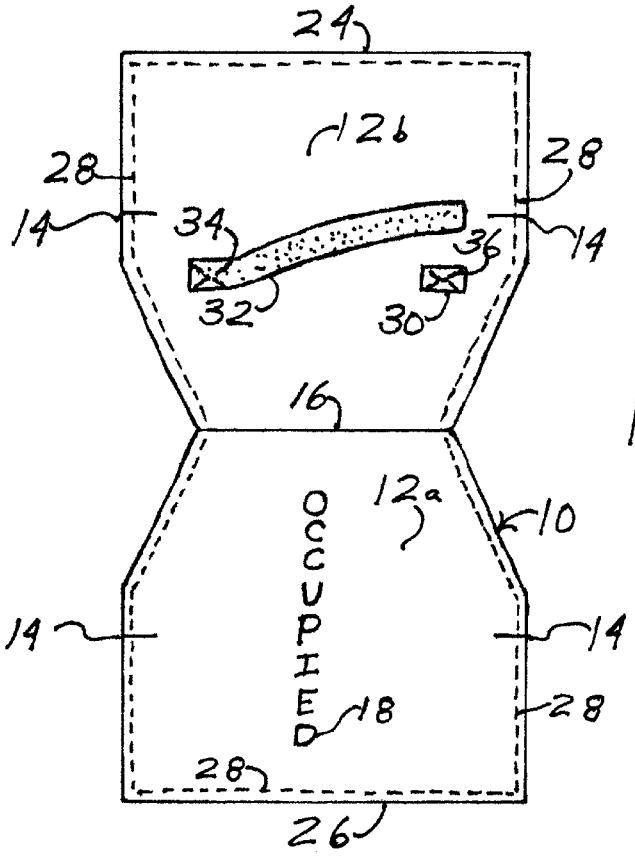
FIG. 1 is a view of the entire preferred embodiment of my invention, a site marking device.

Referring now to FIG. 1 of the drawings, a preferred embodiment of the invention, a site marker is constructed and comprises a main body (10) generally rectangle in configuration, presently approximately twenty-two inches by forty inches. The main body (10) is preferably made from a durable and weather-resistant material in nature, for example, Nylon or similar synthetic material equally durable in characteristics.

The main body (10) is further strengthened with a sewn seam (28) indicated by broken lines along the entire edge forming a hem when necessary to prevent the outer edges from fraying. In addition a fastening device comprised of a tab (30), two inches in length more or less, and an elongated fastener (32), twelve inches more or less of hook and loop. These members (30 and 32), are sewn (34 and 36) on the rear **(12*b*) portion of the embodiment with the intention and purpose of providing appropriate closure to gather and enfold excess material of the device, thereby fitting and securing the main body (10)** over the structure.

Indicia (18) is imprinted on the front member **(12*a*) in varied forms, pictures, logos and the like in bright colors easily seen from a distance and at night. The main body (10) is manufactured in a bright and colorful material. With the combination of color, both of the main body (10) itself and the indicia (18)** imprinted provide a highly visible camping site marker. The camping site marker having been positioned over a utility hook-up post structure and the like, at the camp site will serve the purpose and usefulness of indicating the site is taken.

Figure 2:
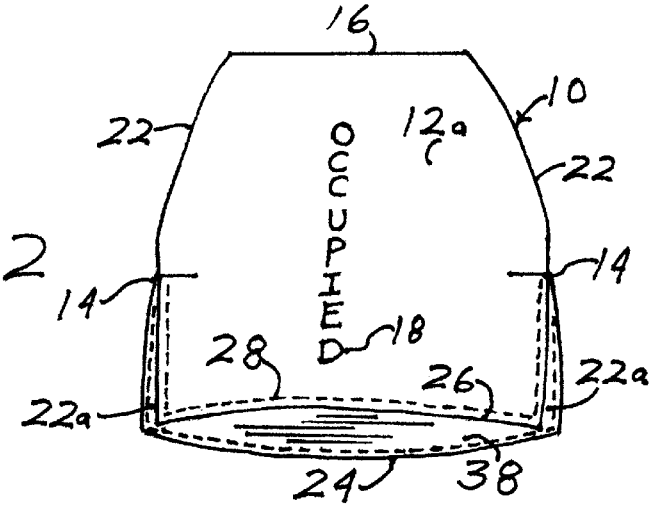
FIG. 2 is a front view of the site marking device folded and sewn.

In reference to FIG. 2, the main body (10) is folded (16) in half creating two equal members, **(12*a* and 12*b*). The fold (16) is fourteen inches, longer or shorter. The two equal members (12*a* and 12*b*) are folded (16) outside to outside. From the top which is now the fold (16) a seam (22) is sewn, becoming the inside seam of the device, is sewn to (14), a point approximately twelve inches down both sides, at the point of (14) there is cross stitching to fortify the end of the side seams (22). Leaving approximately eight inches of opening (22***a*) from the cross stitching at (14) to the bottom edges (26 and 24) extended to the open bottom (38) of the main body (10). Resulting in ease of placement at the utility hook-up post structure also providing multiple adaptation to be utilized on a recreation vehicle outside mirror and the like. More specifically, in all applications the site marker provides a colorful and informative marking of a camping site for use while the camper is departed and additionally utilized while parked at the camping site.

Figure 3:
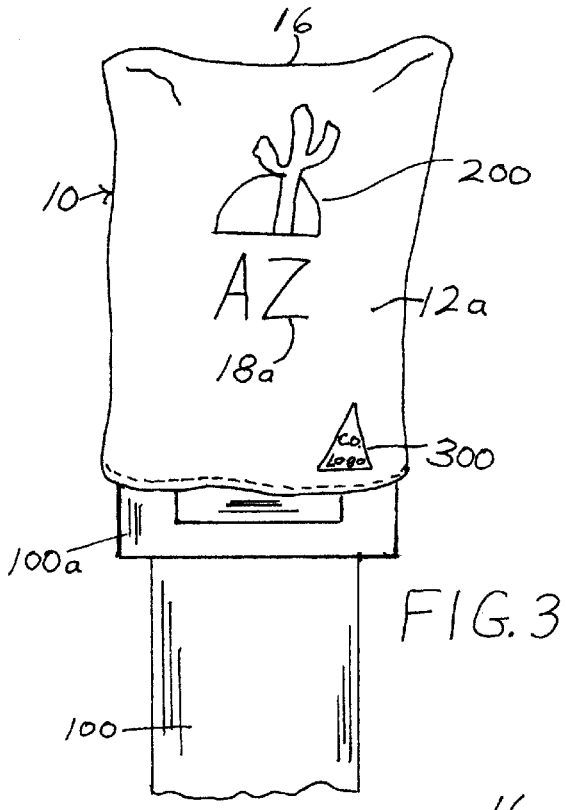
FIG. 3 depicts a front view of the site marker mounted over a utility hook-up post structure.

Referring now to FIG. 3 illustrates the presence of distinct indicia, (200, 300 and 18*a*), unlike that of (18) showing the many variations of indicia that can be imprinted on the main body (10). The main body (10) displaying the front member (12*a*) is mounted over a utility hook-up post structure (100) and (100*a*).

Figure 4:
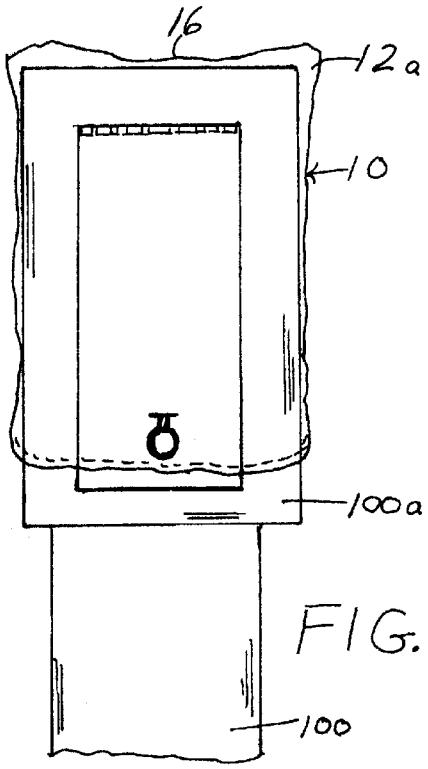
FIG. 4 is a x-ray front view illustrating the relevant relationship between the camping site marker and the utility hook-up post structure.

Turning now to FIG. 4 illustrates a x-ray view of the main body (10) front member (12*a*) placed over a utility hook-up post structure (100 and (100*a*) indicating the relevant relationship between the two.

Figure 5:
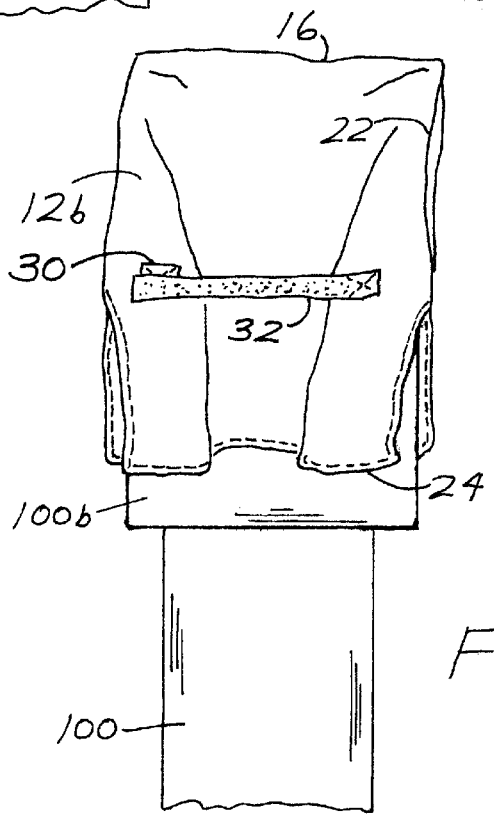
FIG. 5 is a rear view of the camping site marker mounted over a structure showing the fastener in a closed position.

Referring now to FIG. 5 illustrating the rear member (12*b*) view of the main body (10) mounted over a utility hook-up post structure (100 and (100*b*) showing the appropriate closure comprising of a tab (30), two inches longer or shorter, and a length (32) of twelve inches, longer or shorter of hook and loop gathering and enfolding excess material with the intended purpose of fitting and securing the main body to the structure (100 and (100*b*).

Figure 6:
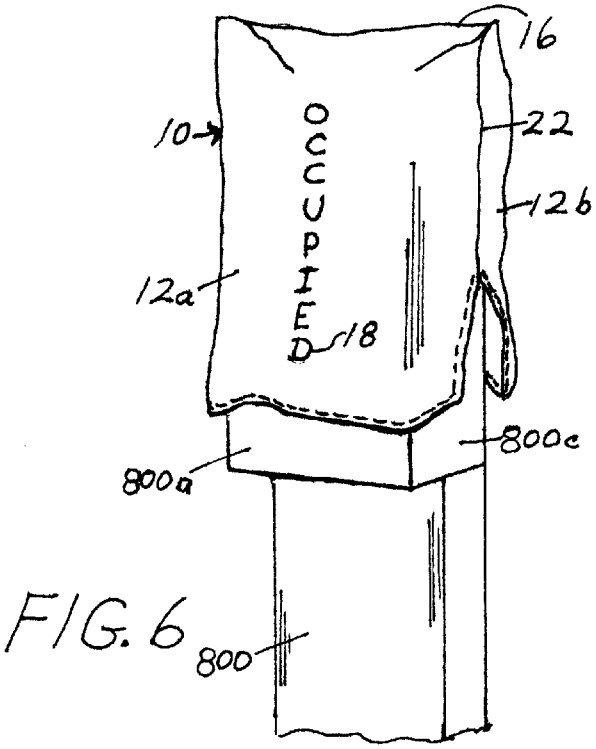
FIG. 6 is a view of the site marking device mounted over a smaller dimensioned utility hook-up post structure.
Figure 7:
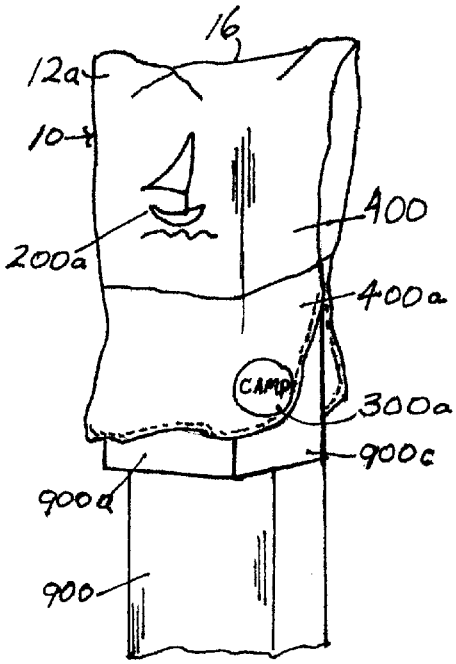
FIG. 7 is a front and side view of the site marking device illustrating multiple colors of material and multiple indicia mounted over a smaller dimensioned utility hook-up post structure.
Figure 8:
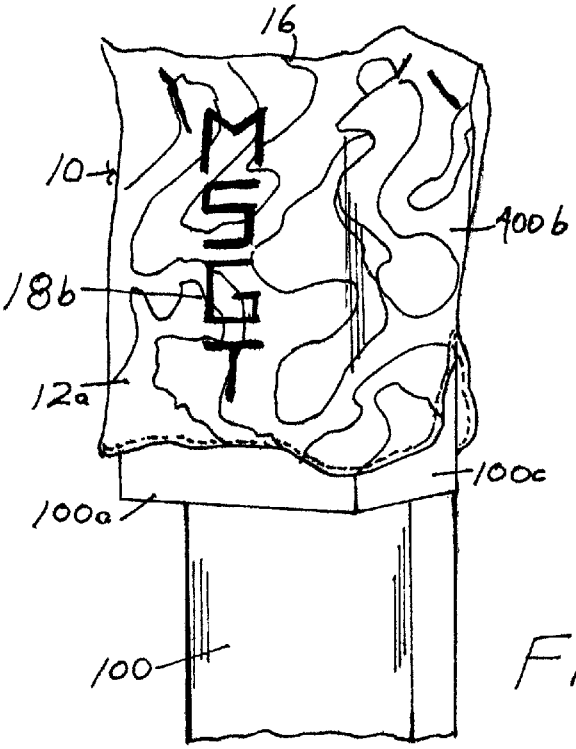
FIG. 8 is a front and side view of the site marking device illustrating another variation of material and indicia on the site marker.

Reference is now made to FIG. 6 as the main body (10) is illustrated on a smaller dimensioned utility hook-up post structure (800, 800*a* and 800*c*). Demonstrating the adaptability of the main body (10). FIG. 7 illustrates placement of the main body (10) to another dimensioned utility hook-up post structure (900, 900*a* and 900*c*), further illustrating the main body (10) manufactured with material (400 and 400*a*) consisting of two bright colors and distinct indicia (200*a* and 300*a*) imprinted. Showing another example in FIG. 8, the main body (10) mounted on a utility site hook-up post structure (100, 100*a* and 100*c*), is fabricated with a distinct material (400*b* and indicia (18*b*) indicating rank in the military services to be possibly utilized by the members of the military camping clubs.

Figure 9:
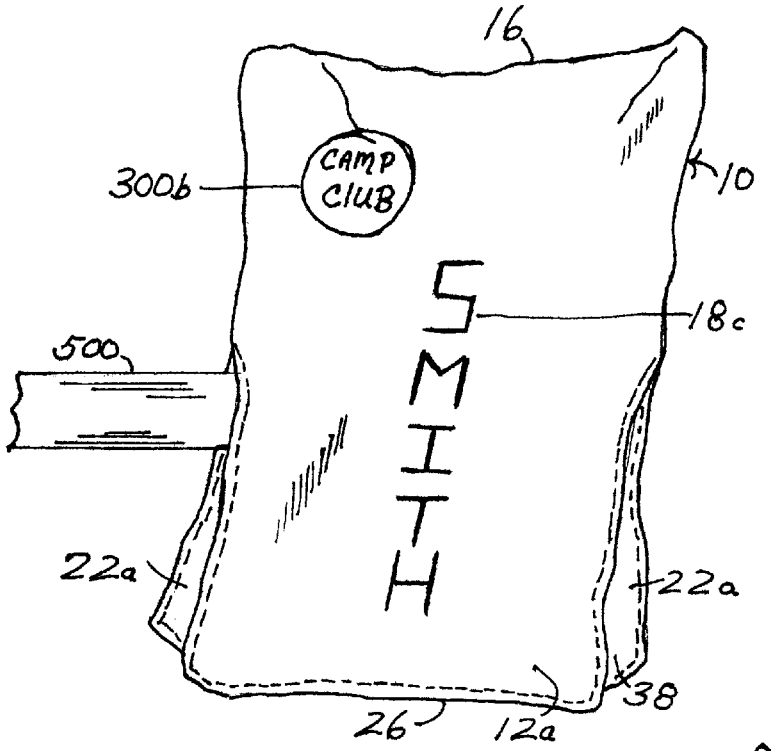
FIG. 9 depicts a view of the site marker illustrating usage on a recreational vehicle mirror structure, showing multiple indicia.

Reference is now made to FIG. 9, it will be further appreciated by those skilled in the art understanding the capability of multiple applications and usage of the main body (10). The illustration shows the front member (12*a*) view of the main body (10) mounted over a recreation vehicle mirror structure (500) with the arm of the mirror extending outward. The open portion of the sides (22*a*) and the open bottom (38) together provide a means for the main body (10) to be adapted to the mirror structure (500 and 500*a*). Also on the front member (12*a*) indicia (18*c* and 300*b*), is imprinted referring to a family name and club.

Figure 10:
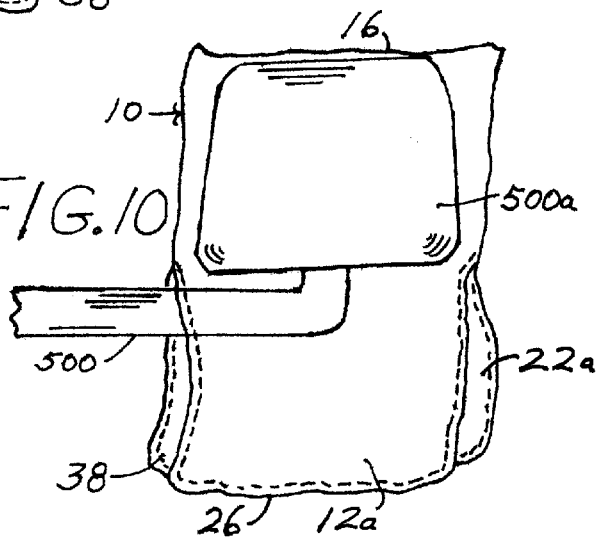
FIG. 10 is a x-ray view illustrating the relevant relationship between the camping site marker and the recreational vehicle outside mirror structure.
Figure 11:
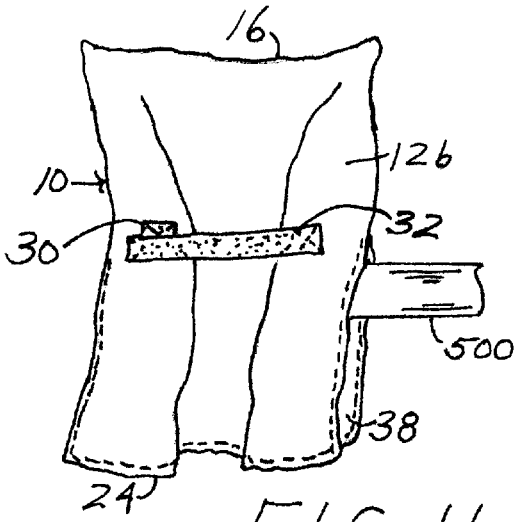
FIG. 11 is a rear view of the camping site marker over the recreational vehicle mirror structure showing the fastener in a closed position.

Turning now to FIG. 10 reference is shown as to the relevant relationship of the main body (10) and the recreation vehicle mirror structure (500 and 500*a*) when placed on display. Wherein FIG. 11 illustrates the rear member (12*b*) of the main body (10) showing the fastening device comprised of a tab (30) and an elongated fastener (32) of hook and loop in a closed position fitting and gathering excess material of the main body (10) mounted over a recreation vehicle mirror structure (500).

In addition to the described and illustrated drawings herein of the site marker it will be appreciated that while particular material and indicia was described as the disclosed embodiment of the invention, it is not intended that the invention be limited thereto, as it is intended that the invention be as broad in scope as the art will allow and that the specification be read likewise. It will be appreciated that other material and indicia could be utilized. It will be recognized that other dimensions and configurations may become necessary. For example, there may be remarkable changes in the dimensions of camping hook-up post structures in the future. It will therefore be appreciated by those skilled in the art that yet other modifications could be made to the provided invention without departing from the spirit and scope as so claimed.

I claim:

1. A camp site marking device for placement over a post or mirror to indicate a camping site is taken while a camper is departed, the camp site marking device comprising: a generally rectangular main body having indicia thereon, the main body is folded in half creating a fold line and a front member and a rear member, the front member and rear member each including a pair of side edges having a length and a bottom edge, the side edges of the front member are fastened to the side edges of the rear member forming a pair of seams, each of the seams extend from the fold line toward the bottom edges of the members, each of the seams have a length which is less than the length of each of the side edges forming a partially closed sided structure which is open on the bottom and along a portion of the side edges; the rear member has a front side and a back side, the front side facing the front member and the back side facing away from the front member, a first fastener attached to the back side of the rear member adjacent to one of the side edges and spaced therefrom and a second fastener member attached to the back side of the rear member adjacent to an opposite side edge and spaced therefrom, the second fastener can directly engage the first fastener to gather and enfold excess material of the main body in order to attach the marking device to the post or mirror in a secure manner.

2. A camp site marking device as in claim 1 wherein, said main body is fabricated from weather-resistant synthetic materials.

3. A camp site marking device as in claim 1 wherein, said main body is partially sewn on said seams leaving approximately one-third open for ease of placement over the post or mirror.

4. A camp site marking device as in claim 1 wherein, said main body comprises one or more bright and colorful weather-resistant materials providing high visibility.

5. A camp site marking device as in claim 1 wherein, said device is comprised of synthetic material rendering it easily stored and handled.

6. A camp site marking device as in claim 1 wherein, said indicia is imprinted on said main body for indicating a family name, hobby, state, membership in a camping club, picture or logo.

7. A camp site marking device as in claim 1 wherein, said first fastener includes a tab and said second fastener includes an elongated fastener.

8. A camp site marking device as in claim 7 wherein, said first and second fasteners include hook and loop.

* * * * *